US005282930A

United States Patent [19]

Lang

[11] Patent Number: 5,282,930

[45] Date of Patent: Feb. 1, 1994

[54] PROCESS AND APPARATUS FOR THE PREPARATION OF BALLOONS

[76] Inventor: Philip E. Lang, 40 Lyttleton Road, Greenways, London, N2 0TW, Great Britain

[21] Appl. No.: 995,931

[22] PCT Filed: Jul. 11, 1989

[86] PCT No.: PCT/GB89/00733

§ 371 Date: Jan. 10, 1991

§ 102(e) Date: Jan. 10, 1991

[87] PCT Pub. No.: WO90/00430

PCT Pub. Date: Jan. 25, 1990

Related U.S. Application Data

[63] Continuation of Ser. No. 634,882, Jan. 10, 1991, abandoned.

[30] Foreign Application Priority Data

Jul. 11, 1988 [GB] United Kingdom ..... 8816470.2

[51] Int. Cl.[5] ..... B32B 31/00

[52] U.S. Cl. ..... 156/289; 156/293; 446/220

[58] Field of Search ..... 156/289, 293, 294, 184; 427/160, 230; 606/192; 53/79, 88; 446/220; 604/349

[56] References Cited

U.S. PATENT DOCUMENTS

| | | | |
|---|---|---|---|
| 2,461,072 | 2/1949 | Miller | 156/294 |
| 3,088,242 | 5/1963 | Rockovits | 446/220 |
| 3,108,396 | 10/1963 | Dorman | 446/220 |
| 3,200,024 | 8/1965 | Leibiger | 156/294 |
| 4,475,910 | 10/1984 | Conway et al. | 604/349 X |
| 4,934,382 | 6/1990 | Barone, Jr. | 604/349 X |

FOREIGN PATENT DOCUMENTS 1498473 10/1967 France .

*Primary Examiner*—David A. Simmons
*Assistant Examiner*—J. Sells

[57] ABSTRACT

An apparatus and process are described for turning inside out (i.e. everting) a part of the neck (7) of a balloon (5). The apparatus essentially comprises an elongate mandrel (1) which is tapered at one end so that is can be inserted into the neck (7) of the balloon (5), and pressure applying means (3), which in use press a portion of the neck (7) against the inserted mandrel (1). The neck (7) is everted simply by a reciprocating motion of the mandrel (1) relative to the pressure applying means (3). An adhesive glue can then be administered to the everted neck portion. There is further described an automated apparatus for everting a plurality of balloons by applying adhesive to each of the everted neck portions, securing each prepared balloon to a protective, removable strip, and packaging the secured balloon in either a cassette or comb form.

17 Claims, 3 Drawing Sheets

Figure 4:
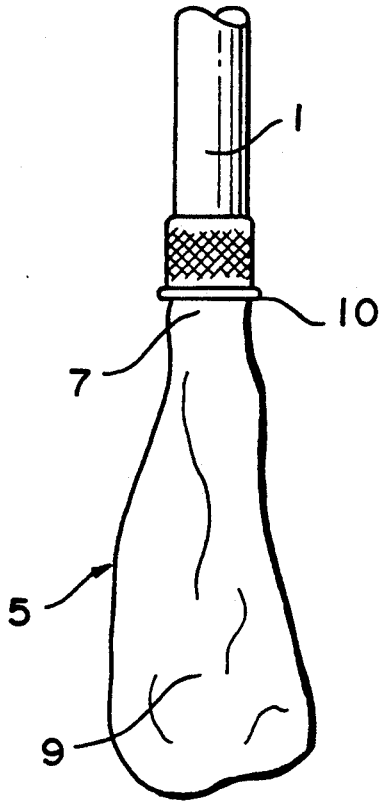

FIG. 1
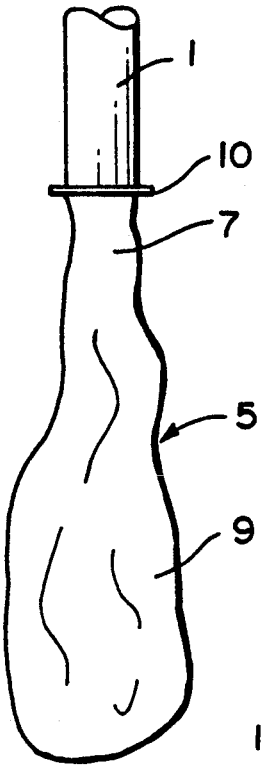
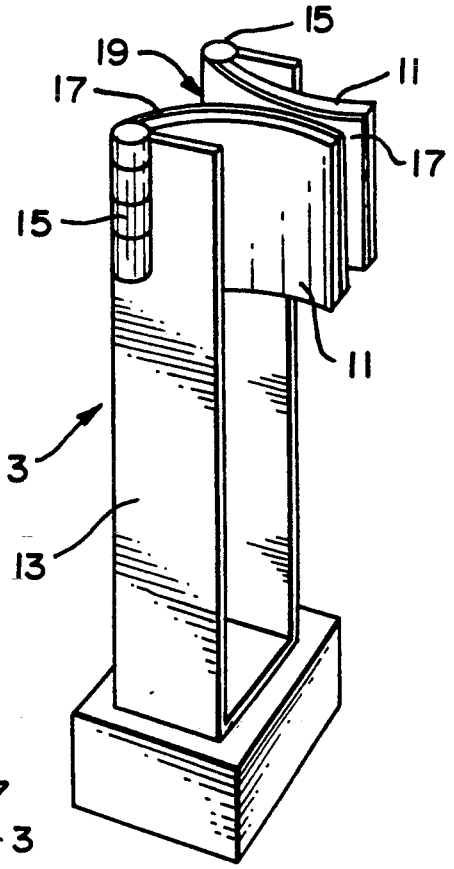
FIG. 2
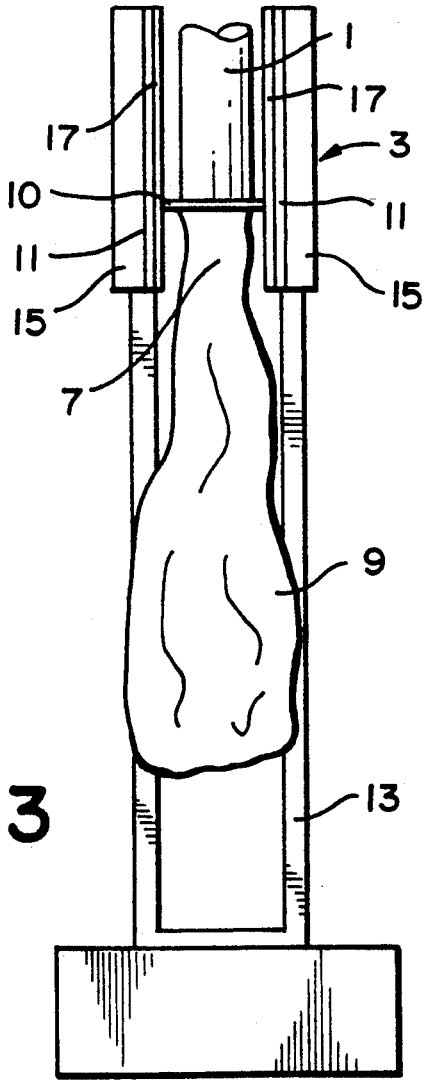
FIG. 3

PROCESS AND APPARATUS FOR THE PREPARATION OF BALLOONS

This is a continuation of application No. 07/634,882 filed Jan. 10, 1991, abandoned.

This invention relates to a process and apparatus for preparing self-sealing balloons.

Balloons in various shapes and sizes are sold for use at many social gatherings (e.g. children's and Christmas parties) and are used in larger quantities at many promotional or sporting events. Traditionally, balloons are inflated either by blowing into them by mouth or by filling them with helium gas from a large cylinder. The neck of the balloon is then knotted to prevent gas escaping. The knotting operation requires dexterity and becomes all the more tiresome when large quantities of balloons need to be inflated and sealed at, for example, promotional events.

Furthermore, a gas-tight seal can never be achieved simply by tying a knot in the neck of a balloon, since there will always remain a minute passage through which gas can escape.

One known method of overcoming the problem of knotting balloons is to use a plug or spring clip. Spring clips are typically applied to the twisted end of the balloon's neck to pinch or squeeze the end thereby halting gas escape. However, irrespective of the force applied by the spring clip, minute passages still exist in the neck allowing gas to escape. Plugs on the other hand are inserted into the neck of the balloon, but these are unsatisfactory as they rely on a force fit which in turn requires very high manufacturing tolerances to provide a gas-tight seal. Furthermore, the use of plugs and spring clips is in general too expensive and too heavy to be of practical use.

It is now common to seal Mylar balloons by heat. The balloon's neck is subjected to hot pressing which locally melts the neck and forms a seal. This requires expensive machinery and is unsuitable for use with the normal elastomeric toy balloons, since these melt destructively under this treatment.

U.S. Pat. Nos. 4,560,360 (Isaacs et al) and 4,516,949 (Schwartz) describe a balloon sealing method in which a seal is made by bringing together opposed inner surfaces of the neck of a balloon which surfaces have previously been coated with a suitable adhesive. Premature sealing is prevented by means of an interior protective insert or strip. In both cases, a tube is inseted into the neck between the protective inserts to allow for the inflation of the balloon. Such balloons are expensive to manufacture since they require extra elements such as protective inserts or strips. Furthermore, considerable manual dexterity is required to remove the inserts or strips once a balloon is inflated.

British Patent Application GB-A-2200299 describes a balloon which can be easily sealed by the use of an adhesive, which can be prepared at low unit cost, which does away with the need for interior protective sheets and which can be adapted to all types of balloons. The balloon described in GB-A-2200299 has at least a portion of its neck turned inside out (i.e. everted) and at least an outer annular part of said portion coated with a contact adhesive such as, for example, an untreated latex.

The balloon described in GB-A-2200299 can be sealed after inflation, simply by unfolding the neck of the balloon with a pulling action and by pinching the neck. The seal produced is entirely gas tight. The balloon does not require any protective strips, since contact adhesive is, in general, non-adhesive except with itself and premature sealing is prevented by the folding of the neck of the balloon. The balloon has the additional advantage in that it can be reused, since it is possible to break the seal by pulling the opposed surfaces of the neck apart.

The present invention provides an apparatus and a process whereby a manual worker, or a machine, can quickly and easily evert at least part of the neck of a balloon, as a preliminary step in the preparation of self-sealing balloons as described in GB-A-2200299.

According to a first aspect of the present invention there is provided a process for everting at least part of the neck of a balloon comprising the steps of inserting at least an end portion of a mandrel into the neck of a balloon; and pressing at least a portion of the neck against the mandrel whilst firstly moving the mandrel relative to the balloon in a direction into the balloon body and subsequently moving the mandrel relative to the balloon in a direction out from the balloon body.

The process may be applied to a balloon with a plain neck, but is especially suitable for conventional balloons provided with an annular collar at the open end of the balloon neck. The action of moving the mandrel in a direction into the balloon body causes the neck of the balloon to roll inwardly from the open end. Surprisingly, reversing the movement of the mandrel does not simply reverse the rolling of the neck, but everts the neck.

According to a second aspect of present invention there is provided an apparatus for everting at least part of the neck of a balloon comprising a mandrel insertable within the neck of the balloon, pressure applying means for pressing at least a portion of the neck against the mandrel, and means for moving the mandrel in a reciprocating fashion relative to the pressure applying means and in a direction at least along the axis of the mandrel.

Preferably, the pressure applying means comprises one or more biased plates. In a preferred arrangement, the pressure applying means comprises a pair of biased plates. Preferably, the plate is curved, so as to enable the mandrel to be easily located within the pressure applying means. A suitable biasing means may include a spring. An alternative pressure applying means comprises one or more inflatable collars which can surround a portion of the neck of the balloon when mounted on the mandrel.

The apparatus may be provided with means for applying, and optionally drying, a layer of a contact adhesive, such as, for example untreated latex, to at least an outer annular part of the everted neck of the balloon.

Preferably, the mandrel is rotatable about its longitudinal axis. Thus, the rotation of the mandrel will facilitate the application, and optional drying, of the contact adhesive to the everted neck of the balloon.

The apparatus can also be provided with means for inserting a tube within the neck portion of the balloon. The apparatus may be further provided with means for forming the tubes from sheets of suitable flexible material.

The purpose of the tubes is that they prevent the collapse of the necks during inflation and they also ease the folding down of the necks of the balloons during preparation. The tubes may be of a plastics material and may optionally be removed once the balloons are inflated. Plastics tubing is cheap and thus this part may be disposable.

Preferably, the tube extends out of the neck of the balloon. This prevents spittle affecting the contact adhesive, if the balloon is to be mouth inflated. The tube may also be easily removed if it extends out of the balloon. Such a tube is preferably provided with means adapted to form a substantially gas-tight connection with a gas source. Preferably, these means are one part of a bayonet fitting. This arrangement allows for a simple gas tight connection to be made to a suitable gas source such as a helium cylinder.

Preferably, the tube is inserted before the neck portion is everted. This may advantageously be achieved by placing a tube over the end of the mandrel, before the mandrel is inserted into the neck of the respective balloon.

The apparatus may have means for applying a removable protective strip to at least the outer annular portion of the everted neck which has an applied layer of adhesive.

The removeable protective strip prevents a collection of the balloons, when packaged loose together, from sticking together. The strip may simply be removed from the exterior of the balloon's neck prior to inflation. Alternatively, there may be provided an assembly comprising a plurality of balloons each having a tube extending out of its neck wherein the tubes are attached to, or integral with a common member at spaced apart intervals. For example, the tubes may form an integral injection moulded comb provided with frangible portions for the ready removal of individual balloons. An alternative assembly comprises a plurality of balloons, each having a tube extending out of its neck, wherein the balloons form a bandolier-type arrangement, which enables the balloons to be stored in cassette form for the ready removal of individual balloons.

The apparatus may be provided with two or more mandrels, each with respective pressure applying means, and means to move each mandrel in a reciprocating fashion relative to each pressure applying means and in a direction at least along the axis of each mandrel. The provision of such an apparatus enables a large quantity of self-sealing balloons to be prepared at a very low unit cost.

A preferred apparatus comprises a plurality of mandrels supported from a common, movable mandrel head; a plurality of pressure applying means supported on a common, movable block; means to apply a layer of self contact adhesive to at least part of the everted neck of each balloon; means to dry the layer of adhesive; means to secure each everted balloon to a removable protective strip; and means to package the secured, everted balloons in either a comb or a cassette form.

A specific embodiment of an apparatus and process according to the present invention is now described, by way of example only, with reference to the accompanying drawings in which:

FIG. 1 is a side elevation of a balloon mounted by its neck on a mandrel for use in the process, FIG. 2 is a perspective view of pressure applying means for use in the process, FIG. 3 is a side elevation of pressure applying means for use in the process, with a mounted balloon located within, FIG. 4 is a side elevation of a balloon having a neck portion everted by the process, while still mounted on a mandrel.

Figure 5:
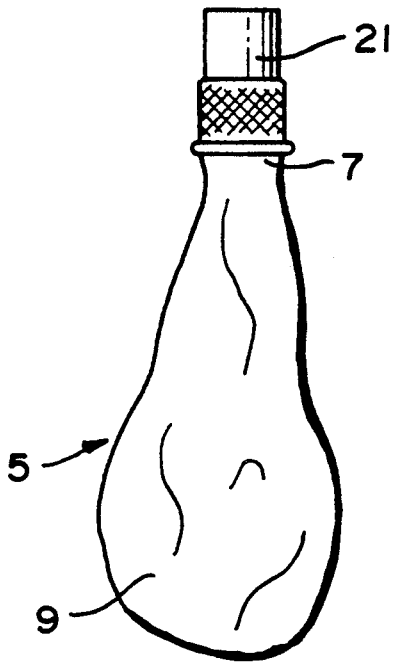
Figure 6:
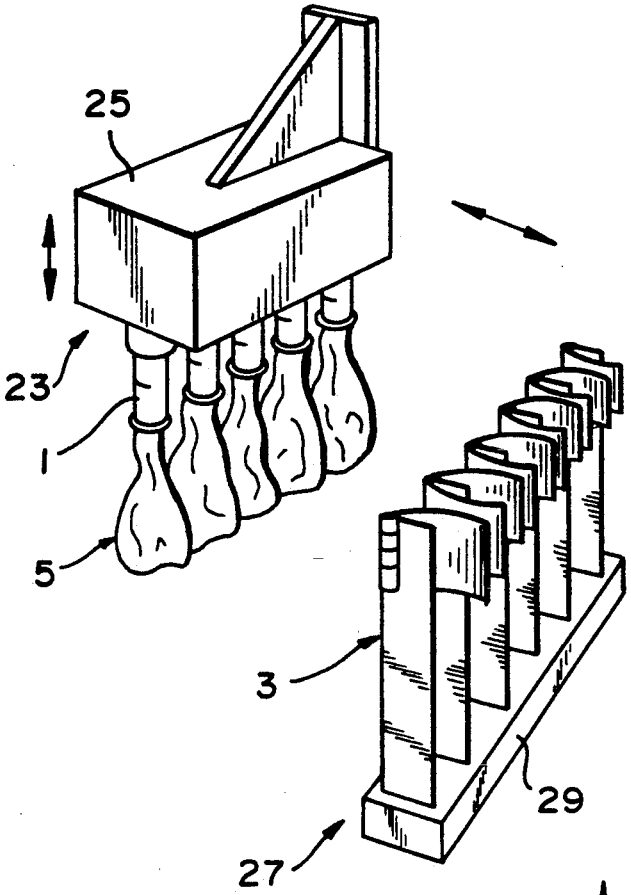
Figure 7:
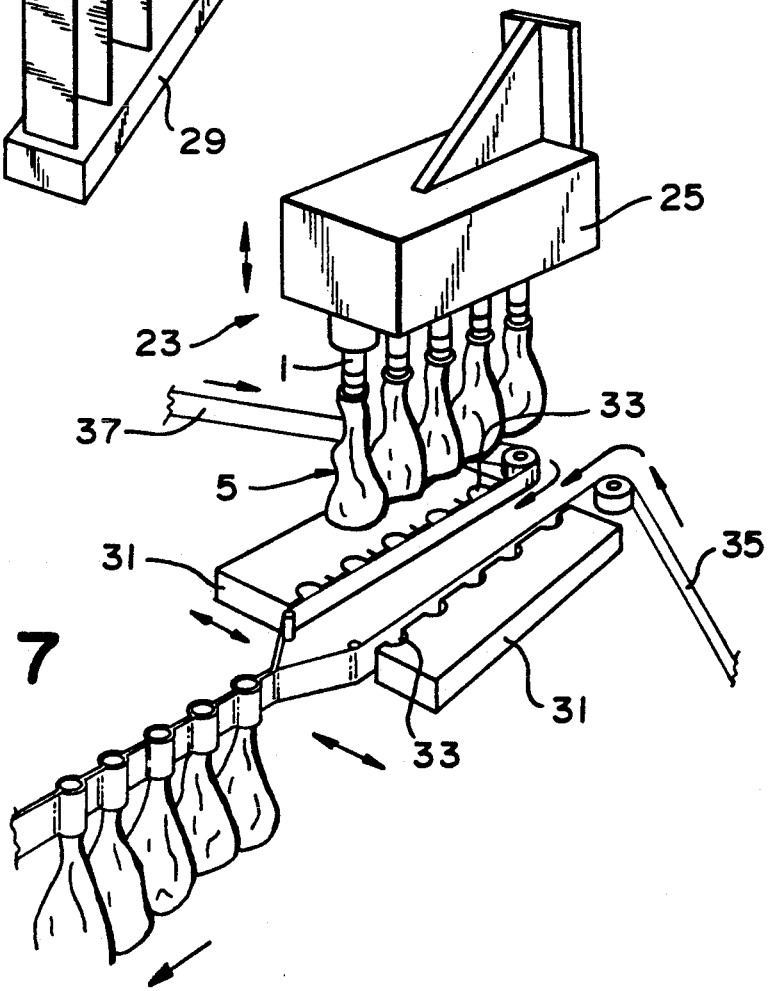

FIG. 5 is a side elevation of a balloon having a tube fitted within the everted neck portion of a balloon, FIG. 6 is a perspective view of a plurality of balloons, each mounted on a mandrel, prior to their insertion into a corresponding number of pressure applying means, and FIG. 7 is a perspective view of the means for packaging balloons having everted neck portions.

Referring to the drawings the apparatus essentially comprises an elongate mandrel 1 and a pressure applying means generally shown as 3.

The mandrel 1 has a tapered end portion (not shown) on which can be mounted a balloon shown generally as 5 in the manner as shown in FIG. 1. Balloon 5 has a neck 7 and a body 9. The end of the neck 7 is provided with an annular collar 10.

The pressure applying means 3 comprises a pair of curved plates 11, each pivoted at one end to a frame 13 by means of a suitable hinge 15. Between each of the hinges 15 and the frame 13 is a spring (not shown), which acts against each of the plates 11 and the frame 13. Onto each of the facing surfaces of plates 11 is affixed a thin rubber pad 17. The plates 11 are biased against each other, and thus define a nip 19 between the hinges 15, as shown in FIG. 2.

In use, to evert at least a portion of the neck 7 of a balloon 5 the end portion of the mandrel 1 is inserted into the neck 7, in a direction towards the balloon body 9, until the balloon 5 is securely mounted on the mandrel 1 as shown in FIG. 1. At this stage, the collar 10 is at a first position along the length of the mandrel 1.

The mandrel 1, with the mounted balloon 5, is then placed into the nip 19, defined by the curved plates 11 of the pressure applying means 3. The mandrel 1 is then moved in a direction towards the free ends of the plates 11. As a result of this movement the free ends of the plates 11 move apart and the rubber pads 17 press against the collar 10 of the mounted balloon 5 in the manner shown in FIG. 3. It is apparent that this step can be conducted manually, or by means of a suitable, automated conveyor arrangement (not shown).

Whilst the pads 17 are firmly pressed against the balloon collar 10, the mandrel 1 is moved in a downwards direction, while frame 13 remains in a fixed position. During the initial downward movement, the collar 10 rolls into the neck 7. On a further downward movement, the outer surface of the neck 7 rolls over the collar 10, now within the neck 7. On yet a further downward movement, the outer surface of the neck 11 rolls over itself within the neck. As a result of the downward motion of the mandrel, the neck rolls over itself and so the mandrel advances into the balloon body 9. Thus collar 10 moves in a rolling motion up the mandrel, within the neck 7, to a second position along the length of the mandrel.

The movement of the mandrel is then stopped, and the mandrel is then moved in an upwards direction, while frame 13 again remains in a fixed position.

During the upward motion of the mandrel 1, the folded neck of the balloon shown generally as 5 begins to fold over itself, as collar 10 rolls over the unfolded portion of the neck 7.

The collar 10 moves in a direction from the second position on the mandrel to the first, and in doing so causes the folded neck portion to evert, as shown in FIG. 4.

When at least a part of the neck 7 has been suitably everted the mandrel with the mounted balloon is then move out from and away from the pressing means. The everted portion of the neck 7 is now ready for the administration of a suitable contact adhesive (i.e. an adhesive which bonds to itself), such as, for example, an untreated latex. When the adhesive has been dried by suitable means (not shown) the balloons are simply removed from the mandrel. The balloons are now prepared and ready for use.

It is apparent from the above description that the same eversion process (i.e. of everting at least part of the neck of the balloon) can be achieved by fixing the position of the mandrel while allowing the pressing means to move in a reciprocating fashion.

A tube 21 may be fitted within the neck of the balloon as shown in FIG. 5. The tube 21 will not only prevent collapse of the balloon neck during inflation, but also prevent spittle affecting the contact adhesive if the balloon is to be inflated by mouth.

One way of fitting a tube within an everted portion of a neck of a balloon is to mount a tube 21 onto the end portion of the mandrel 1, before the mandrel is inserted into the unfolded neck 7 of the balloon 5. In this way, by following the same process described above, at least part of the neck 7 folds and subsequently unfolds over itself along the length of the tube 21. Thus, the everted portion of the neck 7 is mounted on the tube 21, as generally shown in FIG. 5.

It is apparent from the above description that the process for everting at least a part of the neck of a balloon can be performed either manually or by machine. However, if large quantities of balloons are required, it is preferable to have a machine which automates the process.

A suitable arrangement for preparing a number of balloons simultaneously is shown in FIG. 6. The machine essentially comprises a plurality of juxtaposed mandrels 23, each supported from a common mandrel head 25, and a plurality of juxtaposed pressure applying means 27, each supported on a common block 29.

In use, a number of balloons are mounted onto the end of each respective mandrel 1, which may or may not have a mounted tube. The mandrel head 25 then swings towards the pressure applying means 27, in the fashion shown in FIG. 6, until the collar 10 of each balloon is firmly located between the pair of plates 5 of each pressure applying means. Either the mandrel head 25 or the block 29 then moves in an appropriate reciprocating fashion, as described above. The reciprocating motion causes at least a part of the neck of each balloon to evert in the manner described above.

Once at least part of each neck has been everted, the mandrel head 25 swings away from the pressure applying means. This causes each mounted balloon to disengage from its respective pressure applying means. The everted part of the neck of each balloon, while supported on the mandrel, is now ready for the application of a suitable adhesive, such as, for example, untreated latex.

The adhesive is applied to the everted necks whilst each balloon is rotated, and the adhesive is then dried by suitable means (not shown). It will be appreciated that this method of applying adhesive may be used with any balloon having an everted neck, however prepared. Once the adhesive has dried, each prepared balloon can be removed from its respective mandrel either manually or by machine. However, if large quantities of balloons are required, it is preferable to have a machine which automates this removal stage.

A suitable machine for automating the removal stage is shown in FIG. 7. The machine essentially comprises a pair of clamping blocks 31, each having a plurality of recesses 33, and a first web 35 and a second web 37. Webs 35 and 37 run between the clamping blocks 31 in the manner shown in FIG. 7.

In use, the mandrel head 25, supporting the prepared balloons, is lowered until the everted parts of the necks of the balloons are located between the webs 35 and 37. Clamping blocks 31 are then moved together, and in doing so the recesses 31 force portions of each of the webs 35 and 37 to entrap the everted neck portions of each prepared balloon. The web portions located between the recesses are then sealed together, for example by suitable heating means (not shown). The prepared balloons are now removably secured to the sealed webs.

When the prepared balloons have been secured to the webs, the mandrel head 25 moves upwards, causing the prepared balloons to become free from the mandrels. The clamping blocks are then moved apart, and the sealed webs are then advanced, thereby allowing fresh web portions to be located between the blocks.

The secured balloons are then packaged in a suitable fashion, such as, for example, in a cassette form or comb (not shown). Such a cassette or comb form allows a person or an automated machine to inflate a large number of balloons in a small amount of time.

It is of course understood that the present invention has been described purely by way of example only, and modifications of detail can be made within the scope of the invention. It will also be appreciated that the invention can be adapted for use with any balloon such as, for example, bladders, footballs and cycle inner tubes.

I claim:

1. A process for everting at least part of a neck of a balloon having a neck and a body, the process comprising the steps of:

inserting at least an end portion of a mandrel into said neck of said balloon;

inserting said mandrel further into said neck while pressing at least a portion of said neck against said mandrel being inserted therein, to cause a portion of said neck to roll inwardly into said balloon to form a rolled-in portion between said neck and said mandrel as said mandrel is inserted further towards said balloon body; and moving said mandrel relative to said balloon in a reciprocal direction out from said balloon body while pressing at least a portion of said neck including said rolled-in portion against said mandrel, to cause said rolled-in portion between said neck and said mandrel to fold over itself and be everted on the outside of said neck.

2. A process according to claim 1 comprising the further step of applying a layer of a contact adhesive to at least an outer annular part of the everted neck of the balloon.

3. A process according to claim 2 comprising the further step of applying a removable protective strip to at least the outer annular part of the everted neck.

4. A process according to claim 1 wherein the balloon has a collar at the open end of the neck.

5. A process according to claim 2 wherein the adhesive is applied by a method comprising rotating the mandrel with the balloon thereon, and applying said adhesive to said everted neck from a stationary source adjacent to the mandrel.

6. A process for everting at least part of a neck of a balloon as defined in claim 1 wherein the neck of a number of balloons are everted and the method further comprising the step of attaching the balloons to a web by disposing the necks of said balloons mounted on the mandrel between two webs and sealing the two webs to each other in the region between adjacent balloons.

7. In combination, a balloon having a neck and a body, and an apparatus for everting at least part of said neck of said balloon, said apparatus comprising:

a mandrel inserted partly into said neck;

pressure applying means for pressing at least a portion of said neck against said mandrel partly inserted in said neck;

means for advancing said balloon neck further on to said mandrel while said pressure applying means presses said portion of said neck against said mandrel to cause said portion of said neck to pull inwardly against said mandrel to form a rolled-in portion inside said neck;

wherein said means for advancing comprises means for relatively moving said mandrel and said balloon in a first direct to insert said mandrel further into said neck towards said body; and wherein said apparatus further comprises means for relatively moving said mandrel and said balloon in a second direction to move said mandrel out from said body of said balloon while said pressure applying means presses said neck including said rolled-in portion against said mandrel to cause said rolled-in portion to fold over itself and be everted on the outside of said neck.

8. Apparatus as claimed in claim 7 wherein the pressure applying means comprises one or more biased plates.

9. Apparatus as claimed in claim 8 wherein the pressure applying means comprises a pair of biased plates.

10. Apparatus as claimed in claim 7 wherein the or each plate has a convex pressure applying surface.

11. Apparatus as claimed in claim 8 wherein the or each plate is biased by means of a hinge and spring arrangement.

12. Apparatus as claimed in claim 7, further comprising means for applying and optionally drying an adhesive to the everted portion of said neck.

13. Apparatus as claimed in claim 7 wherein a tube is located over the end of said mandrel before said mandrel is inserted into said neck of said balloon.

14. Apparatus as claimed in claim 7, further comprising means for applying a removable, protective strip to at least the portion of the everted neck.

15. Apparatus as claimed in claim 14, further comprising means for packaging the baboon secured to the protective strip.

16. Apparatus according to claim 7 comprising a plurality of said elongate mandrels and corresponding pressure means.

17. Apparatus as claimed in claim 16 wherein each mandrel is supported from a common, movable mandrel head, and each pressure applying means is supported on a common, movable block.

* * * * *